US010245476B2

(12) United States Patent
Abbott et al.

(10) Patent No.: US 10,245,476 B2
(45) **Date of Patent: *Apr. 2, 2019**

(54) GOLF CLUB FACE INSERT

(71) Applicant: Callaway Golf Company, Carlsbad, CA (US)

(72) Inventors: Craig E. Abbott, Klamath Falls, OR (US); Augustin W. Rollinson, Solana Beach, CA (US); Patrick Dawson, San Diego, CA (US); Sean Toulon, Vista, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/059,898

(22) Filed: Aug. 9, 2018

(65) Prior Publication Data

US 2018/0345089 A1 Dec. 6, 2018

Related U.S. Application Data

(63) Continuation of application No. 15/796,431, filed on Oct. 27, 2017, now Pat. No. 10,052,529, which is a continuation-in-part of application No. 15/706,761, filed on Sep. 18, 2017, now Pat. No. 9,981,161, which is a continuation of application No. 15/189,774, filed on Jun. 22, 2016, now Pat. No. 9,776,051.

(60) Provisional application No. 62/247,589, filed on Oct. 28, 2015.

(51) Int. Cl.

| | |
|---|---|
| ***A63B 53/00*** | (2015.01) |
| ***A63B 53/04*** | (2015.01) |
| ***A63B 60/50*** | (2015.01) |

(52) U.S. Cl.

CPC ..... *A63B 53/04* (2013.01); *A63B 53/007* (2013.01); *A63B 53/0487* (2013.01); *A63B 60/50* (2015.10); *A63B 2053/0408* (2013.01); *A63B 2053/0416* (2013.01); *A63B 2053/0445* (2013.01); *A63B 2209/00* (2013.01)

(58) Field of Classification Search

CPC ... A63B 53/04; A63B 53/007; A63B 53/0487; A63B 2053/0416; A63B 2053/0445; A63B 2209/00; A63B 2053/0408; A63B 60/50

USPC ..... 473/324–350, 287–292

See application file for complete search history.

(56) References Cited

U.S. PATENT DOCUMENTS

D431,853 S * 10/2000 Antonious ..... D21/759
6,224,497 B1 * 5/2001 Antonious ..... A63B 53/04 473/330

(Continued)

*Primary Examiner* — Sebastiano Passaniti
(74) *Attorney, Agent, or Firm* — Rebecca Hanovice; Michael Catania; Sonia Lari

(57) ABSTRACT

A resilient face insert for a golf club head, preferably a putter head, is disclosed herein. In particular, the face insert comprises a plurality of hinge features spaced from a striking surface to ensure consistent ball speed across the striking surface. At least a portion of each hinge feature extends parallel to the striking surface without making contact with the striking surface. In the preferred embodiment, each hinge feature comprises a tab portion that is spaced from the striking surface by a stem portion and that extends parallel to the striking surface. The hinge features may be co-molded with a polymeric backing material having a plurality of parallel grooves in order to further improve performance of the face insert.

20 Claims, 7 Drawing Sheets

(56) References Cited

U.S. PATENT DOCUMENTS

| | | | | |
|---|---|---|---|---|
| 6,257,994 | B1 * | 7/2001 | Antonious | A63B 53/0487 473/331 |
| 9,776,051 | B1 * | 10/2017 | Abbott | A63B 53/04 |
| 9,981,161 | B2 * | 5/2018 | Abbott | A63B 53/04 |
| 10,052,529 | B1 * | 8/2018 | Abbott | A63B 53/0487 |

* cited by examiner

GOLF CLUB FACE INSERT

CROSS REFERENCES TO RELATED APPLICATIONS

The present application is a continuation of U.S. patent application Ser. No. 15/796,431, filed on Oct. 27, 2017, and issued on Aug. 21, 2018, as U.S. Pat. No. 10,052,529, which is a continuation-in-part of U.S. patent application Ser. No. 15/706,761, filed on Sep. 18, 2017, and issued on May 29, 2018, as U.S. Pat. No. 9,981,161, which is a continuation of U.S. patent application Ser. No. 15/189,774, filed on Jun. 22, 2016, and issued on Oct. 3, 2017, as U.S. Pat. No. 9,776,051, which claims priority to U.S. Provisional Patent Application No. 62/247,589, filed on Oct. 28, 2015, the disclosure of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club face insert comprising a plurality of hinge features, each comprising a stem portion and a suspended tab portion, extending from and disposed across a striking surface.

Description of the Related Art

The prior art discloses many different types of face inserts for golf club heads, including putters, that are intended to improve face performance. For example, U.S. Pat. No. 7,278,928 discloses a striking face with a plurality of solid geometric protrusions, U.S. Pat. No. 7,824,278 discloses a putter face with a plurality of pillar-shaped bodies made of a material having a higher rigidity than a golf ball, U.S. Pat. No. 8,109,841 discloses a face with a plurality of microscopic protrusions having a stiffness higher than that of a golf ball, and U.S. Pat. No. 8,371,958 discloses a golf club face with a plurality of pyramidal shaped extensions protruding therefrom. There is, however, still a need for a putter face that optimizes performance and increases the consistency of ball speed across the face.

BRIEF SUMMARY OF THE INVENTION

One aspect of the present invention is a golf club face insert comprising a striking plate comprising a base portion, at least one hinge feature, and a first thickness, wherein the at least one hinge feature comprises a stem portion that extends from the base portion at an angle of no less than 45 degrees and no more than 90 degrees, a tab portion that is spaced from the base portion by the stem portion and extends from the stem portion approximately parallel to the base portion without making contact with the base portion, and a first notch disposed at an intersection between the tab portion and the stem portion, and wherein the tab portion has a top-to-bottom length that is less than a heel-to-toe width. In some embodiments, the angle is between 50 degrees and 60 degrees, and in yet a further embodiment, the angle is approximately 57 degrees. In a further embodiment, the face insert may comprise a second notch disposed at an intersection between the stem portion and the base portion. In yet another, further embodiment, the first notch may extend into an interior surface of the hinge feature, and the second notch may extend into an exterior surface of the hinge feature.

In some embodiments, the hinge feature may have a minimum thickness of no less than 0.005 inch, and a maximum thickness of no more than 0.025 inch. In other embodiments, the length of the tab portion may range from 0.020 inch to 0.075 inch. In a further embodiment, the length of the tab portion may range from 0.050 inch to 0.060 inch, and a width of the tab portion may be at least 1.5 times the length of the tab portion. In still other embodiments, the tab portion may be spaced from the base portion by a distance ranging from 0.030 inch to 0.060 inch. In any of the embodiments, the golf club face insert may further comprise a backing portion affixed to the striking plate, and the backing portion may comprise a second thickness that is greater than the first thickness. In a further embodiment, the backing portion may comprises at least one groove extending horizontally across the backing portion in a heel-to-toe direction, and the groove may be disposed above the tab portion of the at least one hinge feature. In yet another embodiment, the backing portion may be composed of a polymeric material, the striking plate may be composed of a metal material, and the backing portion may be co-molded with the striking plate.

In other embodiments, the at least one hinge feature may comprise at least three hinge features aligned along a horizontal heel-to-toe axis, and each hinge feature may be spaced from each adjacent hinge feature by a distance of 0.020 to 0.060 inch. In still other embodiments, the striking plate may comprise at least one through-hole, which may be at least partially disposed beneath the tab portion of the at least one hinge feature.

Another aspect of the present invention is a golf club face insert comprising a striking plate comprising a base portion, at least one hinge feature, at least one through-hole, and a first average thickness, a backing portion comprising a front surface, at least one groove extending into the front surface in a heel-to-toe direction, and a second average thickness that is greater than the first average thickness, wherein the striking plate is embedded within the backing portion so that the backing portion at least partially covers the base portion and at least partially fills the at least one through-hole, wherein the at least one hinge feature comprises a stem portion that extends from the base portion at an angle of less than 90 degrees, and a tab portion that is spaced from the base portion by the stem portion and extends from the stem portion approximately parallel to the base portion without making contact with the base portion, and wherein the tab portion of the at least one hinge feature protrudes from the backing portion proximate a lower edge of the at least one groove.

In some embodiments, the at least one groove may comprise first and second grooves, which may extend parallel with one another, and a plurality of hinge features may be aligned in rows at lower edges of each of the first and second grooves. In other embodiments, the at least one through-hole may be at least partially disposed beneath the tab portion of the at least one hinge feature. In still other embodiments, the backing portion may be composed of a polymeric material, the striking plate may be composed of a metal material, and the backing portion may be co-molded with the striking plate. In still other embodiments, the tab portion may have a thickness of 0.010 to 0.040 inch, and the at least one groove may have a depth that is approximately equivalent to the thickness of the tab portion. In another embodiment, the at least one hinge portion may comprise a notch disposed at an intersection between the tab portion and the stem portion.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
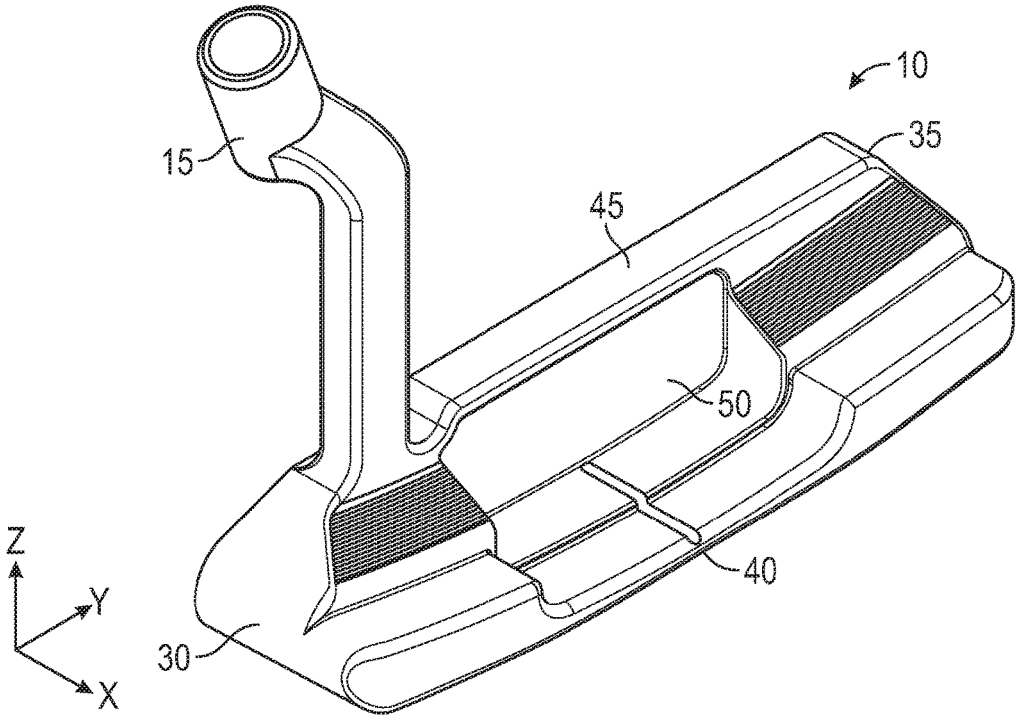
FIG. 1 is a rear perspective view of a putter head sized to receive any of the face inserts of the present invention.

Each embodiment of the present invention is directed to a face insert 100 for a golf club head, preferably a putter head 10, which provides consistent ball speed and improved spin across the striking surface. FIG. 1 shows an exemplary putter head 10, which would benefit from any of the embodiments of the face insert 100 of the present invention. The putter head 10 preferably comprises a hosel 15, a face 20 with a recess 22 sized to receive the face insert 100 of the present invention, a heel side 30, a toe side 35, a sole portion 40, a top portion 45, and a rear portion 50 opposite the face 20. A coordinate system is defined by a y-axis extending in a heel-to-toe direction parallel with the face 20, a z-axis extending perpendicular to the y-axis from the sole portion 40 to the top portion 45, and an x-axis extending perpendicular to both the y- and z-axes from the face 20 to rear portion 50.

Figure 2:
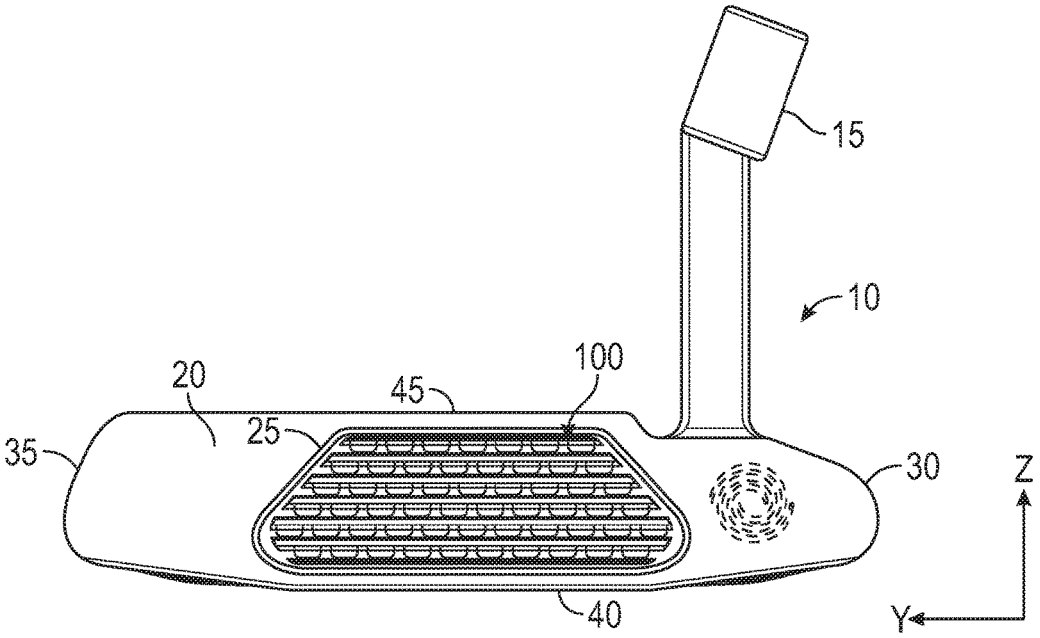
FIG. 2 is a front elevational view of the putter head shown in FIG. 1 with a first embodiment of the face insert of the present invention.
Figure 3:
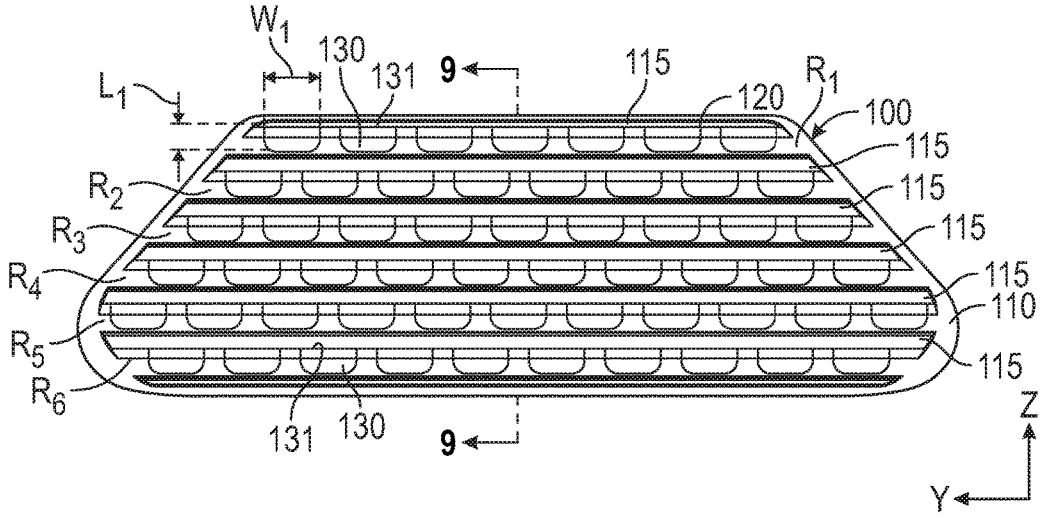
FIG. 3 is a front plan view of the face insert shown in FIG. 2.
Figure 4:
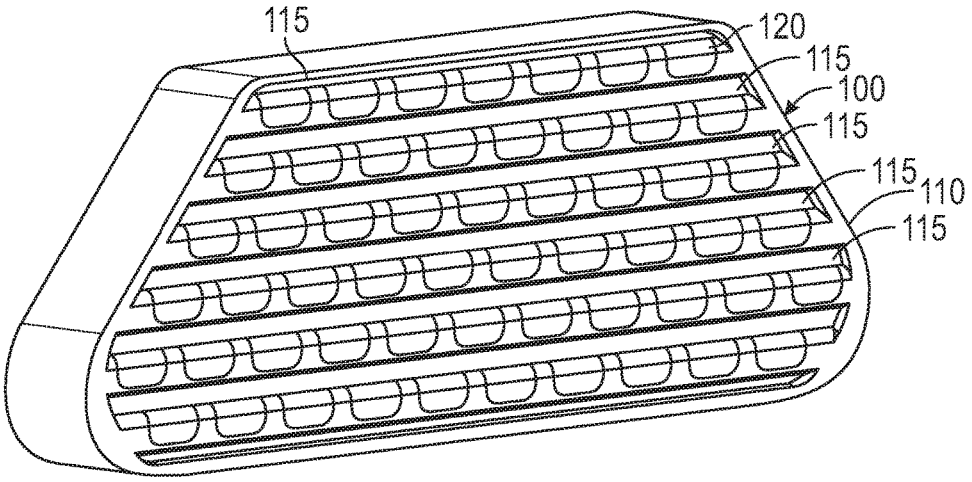
FIG. 4 is a front perspective view of the face insert shown in FIG. 3.
Figure 5:
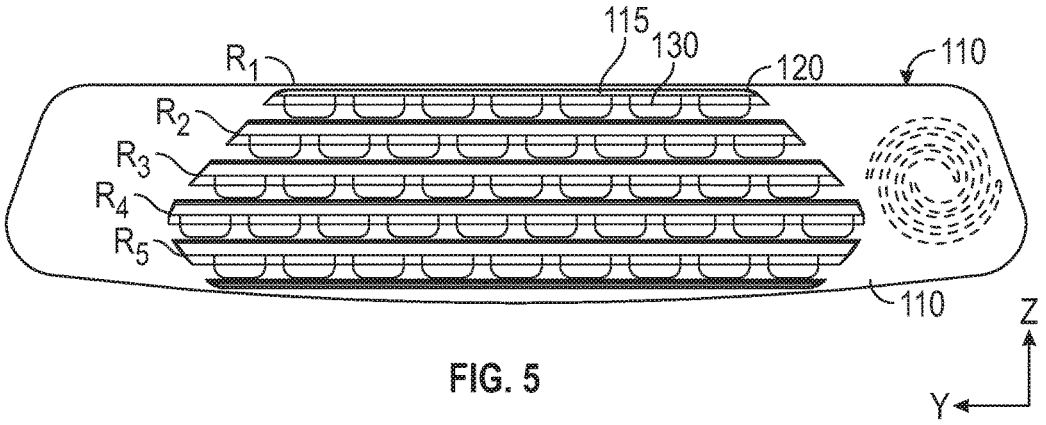
FIG. 5 is a front plan view of a second embodiment of the face insert of the present invention.
Figure 6:
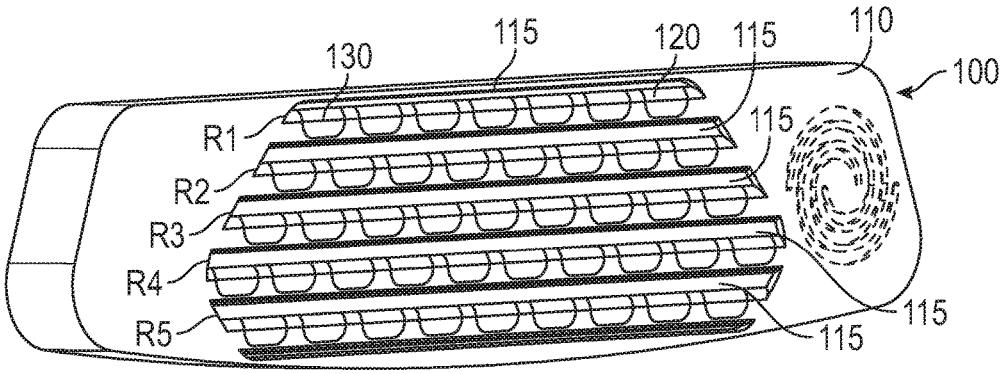
FIG. 6 is a front perspective view of the face insert shown in FIG. 5.

A first, preferred embodiment of the present invention is shown in FIGS. 2, 3 and 7-10, and a second, alternative embodiment is shown in FIGS. 4-5. In these embodiments, the face insert 100 comprises two parts: a backing portion 110 with a plurality of parallel grooves 115 extending along the y-axis in a heel-to-toe direction, and a thin striking plate 120 comprising a planar base portion 122 with a plurality of through-holes 124 and a plurality of hinge features 130.

Figure 9:
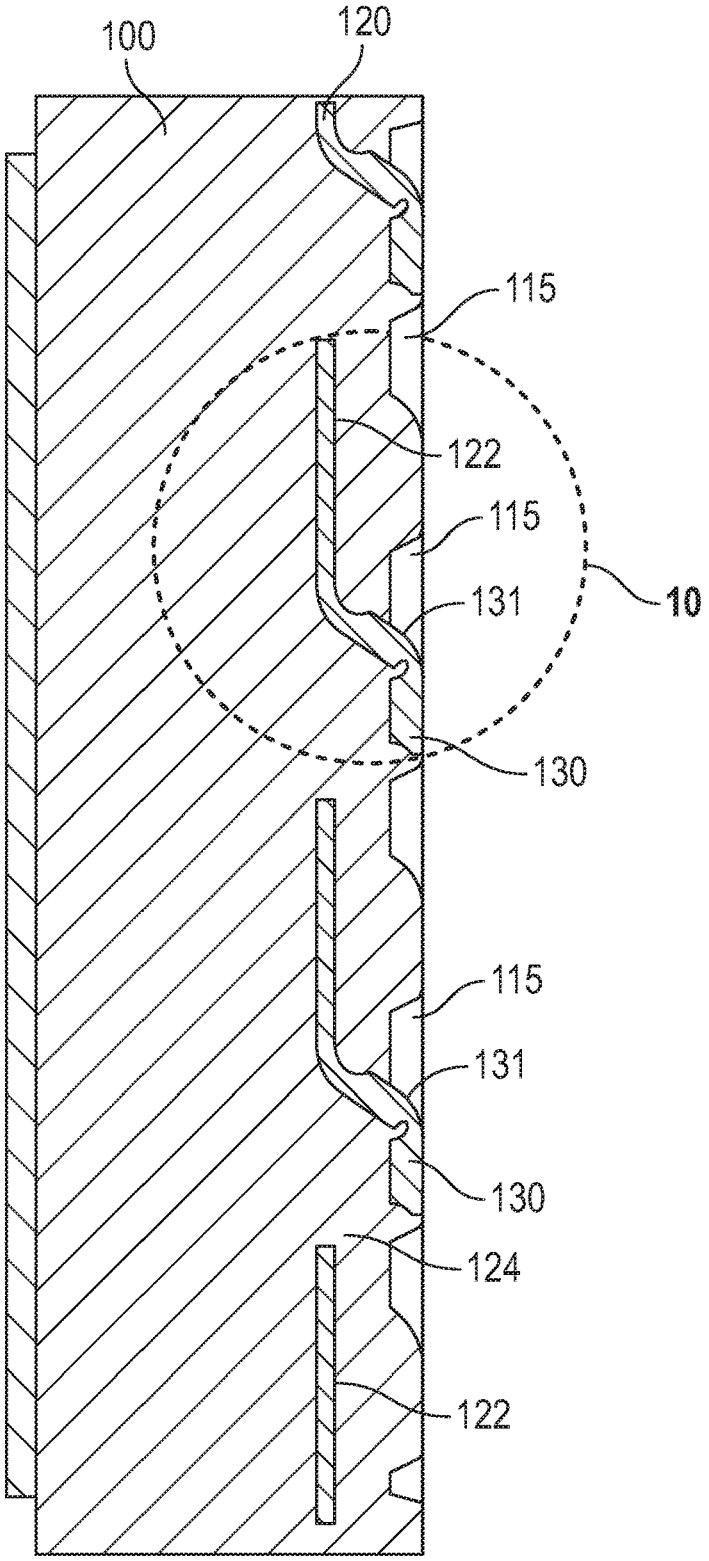
FIG. 9 is a cross-sectional view of the embodiment shown in FIG. 3 along lines 9-9.
Figure 10:
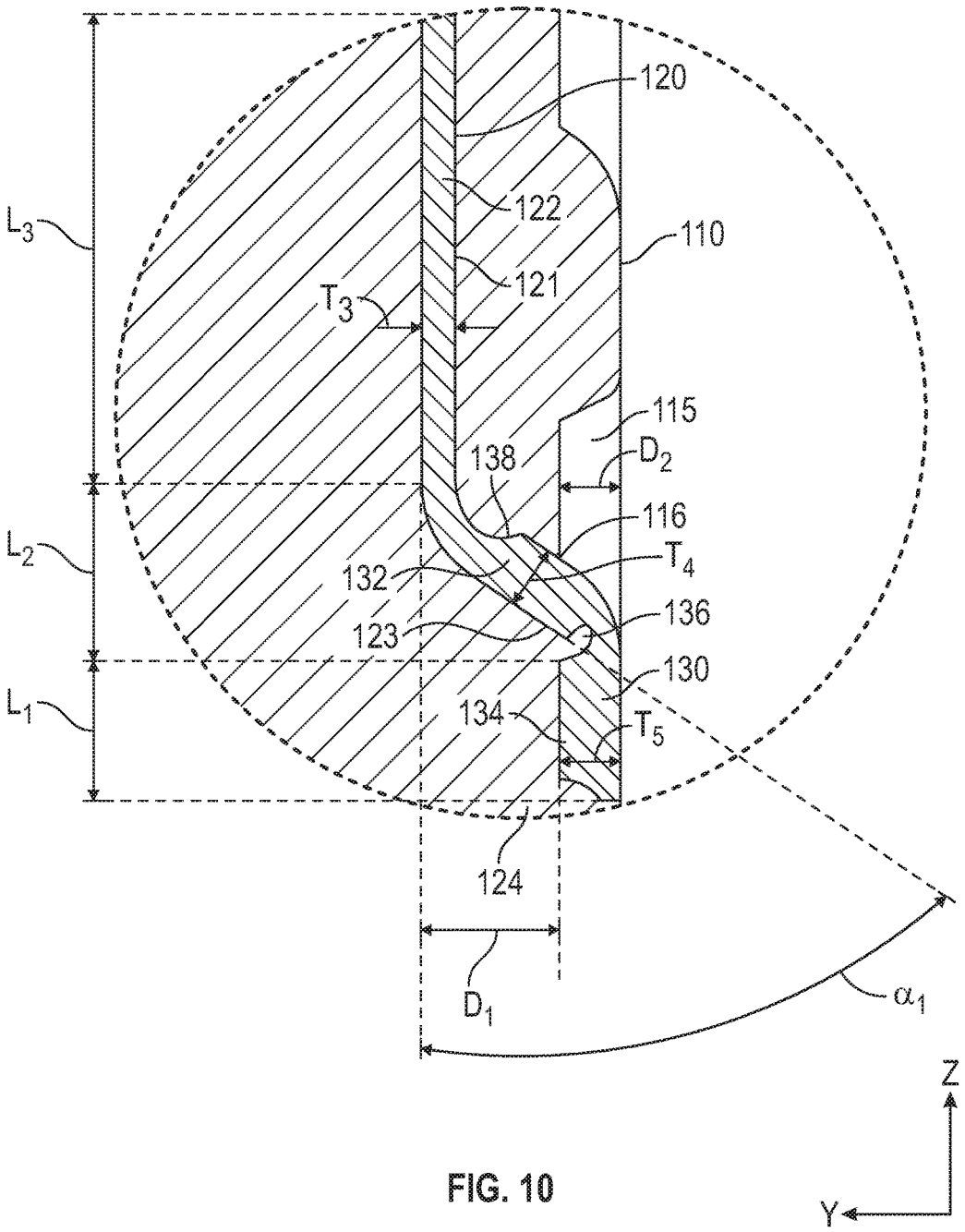
FIG. 10 is an enlarged view of the circled portion of the embodiment shown in FIG. 9.

As shown in FIGS. 9-10, each hinge feature 130 comprises a stem portion 132 that is connected to, and extends at an angle $\alpha 1$ of 45-90° (most preferably approximately 57°) away from, the base portion 122, and a tab portion 134 that is spaced from an inner surface 123 of the base portion 122 a distance $D_1$ of 0.030 inch to 0.060 inch (most preferably approximately 0.40 inch) along the x-axis and extends away from the stem portion 132 and parallel with the base portion 122 along the z-axis. A first notch 136 extends into the inner surface 123 of the hinge feature 130 at the intersection between the stem portion 132 and the tab portion 134, and a second notch 138 extends into the outer surface 121 of the hinge feature 130 at the intersection between the base portion 122 and the stem portion 132. As shown in FIG. 10, each tab portion 134 preferably is disposed over a through-hole 124.

Each tab portion 134 has a top-to-bottom length $L_1$ along the z-axis ranging from 0.020 to 0.075 inch, and more preferably approximately 0.047 inch, a heel-to-toe (y-axis) width $W_1$ that is greater than $L_1$, and more preferably at least 1.5 times $L_1$, and a thickness $T_5$ of 0.010 to 0.040 inch, more preferably approximately 0.020 inch. The base portion 122 of the striking plate 120 preferably has a thickness $T_3$ of 0.005 to 0.030 inch, more preferably approximately 0.011 inch, and an average vertical length $L_3$ along the z-axis of 0.100 to 0.200 inch, more preferably approximately 0.150 inch. The stem portion 132 has a thickness of $T_4$ of 0.010 to 0.040, more preferably approximately 0.021 inch, and an average vertical length $L_2$ along the z-axis of 0.025 to 0.075 inch, and more preferably approximately 0.056 inch.

FIGS. 9-10 illustrate how the striking plate 120 and backing portion 110 engage with one other, with the grooves 115 disposed above the tab portions 134 along the z-axis, and the backing portion 110 filling the through-holes 124 underneath the tab portions 134 in the striking plate 120. The backing portion 110 also covers the planar base portion 122 so that the upper surface 135 of each tab portion 134, and each of the grooves 115, is exposed and can connect with a golf ball. The stem portion 132 of each hinge feature 130 extends through the backing portion 110 proximate a lower edge 116 of a groove 115, so that the hinge features 130 are aligned with one another along the one or more grooves 115. Each of the grooves has a depth $D_2$ that is at least as great as (or, in other embodiments, approximately equivalent to) the thickness $T_5$ of the tab portion 134. As shown in FIGS. 2-3, the face insert 100 has six rows $R_{1-6}$ of hinge features 130, the upper edges 131 of each of which align with a groove 115 in the backing portion 110. Each hinge feature 130 in a row R is preferably spaced from adjacent hinge features in the row by a distance of 0.010 to 0.075 inch, more preferably 0.020 to 0.060 inch.

When contacted by a golf ball, the tab portions 134 are compressed inwards towards the backing portion 110 and the base portion 122, and provide the face insert 100 with improved elasticity, improving the topspin imparted to the golf ball. The first and second notches 136, 138 improve the bending properties of the tab portions 134, allowing them to flex inwards and outwards more easily. The grooves 115 in the backing portion 110 also contribute to improved spin imparted to the golf ball.

Figure 7:
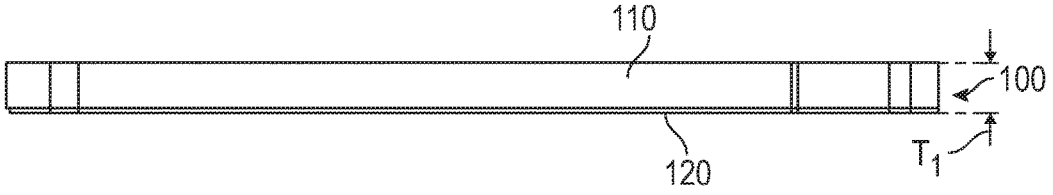
FIG. 7 is a side plan view of the face insert shown in FIG. 3.
Figure 8:
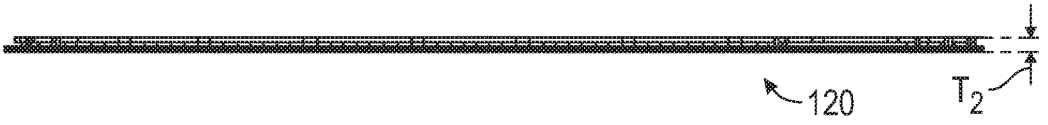
FIG. 8 is a side plan view of the striking plate shown in FIG. 3.

In the preferred embodiment, the backing portion 110 has the same approximate, trapezoidal shape and z-axis length and y-axis width dimensions as the striking plate 120, while in the embodiment shown in FIGS. 4-5, the backing portion 110 has significantly larger z-axis length and y-axis width dimensions than the striking plate 120. In each of the embodiments, the backing portion 110 has a significantly larger thickness (measured along the x-axis) than that of the striking plate 120. As shown in FIGS. 7 and 8, the striking plate 120 has an average thickness $T_2$ that is less than 25% of the overall, average thickness $T_1$ of the face insert 100. Each of the embodiments of the face inserts 100 disclosed herein preferably has at least five rows $R_{1-5}$ of hinge features 130, with at least twenty-five hinge features 130 extending from the striking plate 120 and embedded within the backing portion 110.

As shown in the first and second embodiments herein, all of the hinge features 130 can be oriented such that each tab portion 134 extends away from the stem portion 132 along the z-axis towards the sole portion 40. This orientation can be altered, however, to control the spin imparted to a golf ball impacted at different locations on the face insert 100. For example, in the embodiments shown in FIGS. 11-14, the face insert 100 has a middle section 140, a toe section 142, and a heel section 144, each with hinge features 130 having tab portions 134 that extend in different directions from the tab portions 134 disposed on a different section 140, 142, 144.

Figure 11:
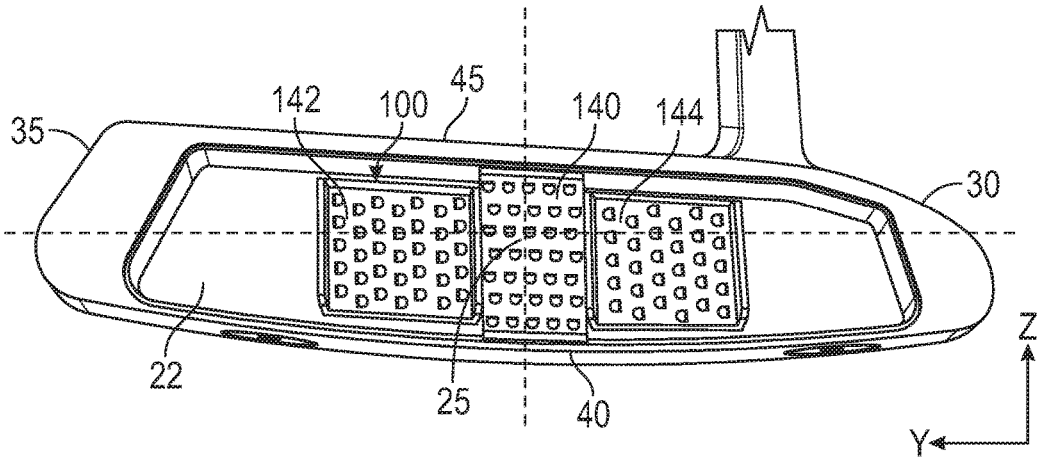
FIG. 11 is a front perspective view of the putter head shown in FIG. 1 with a third embodiment of the face insert of the present invention.
Figure 12:
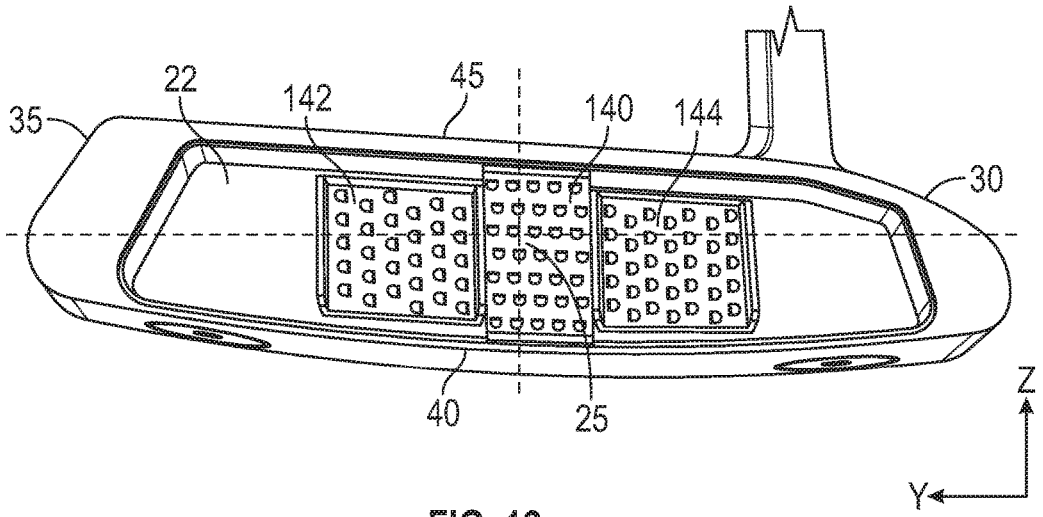
FIG. 12 is a front perspective view of the putter head shown in FIG. 1 with a fourth embodiment of the face insert of the present invention.
Figure 13:
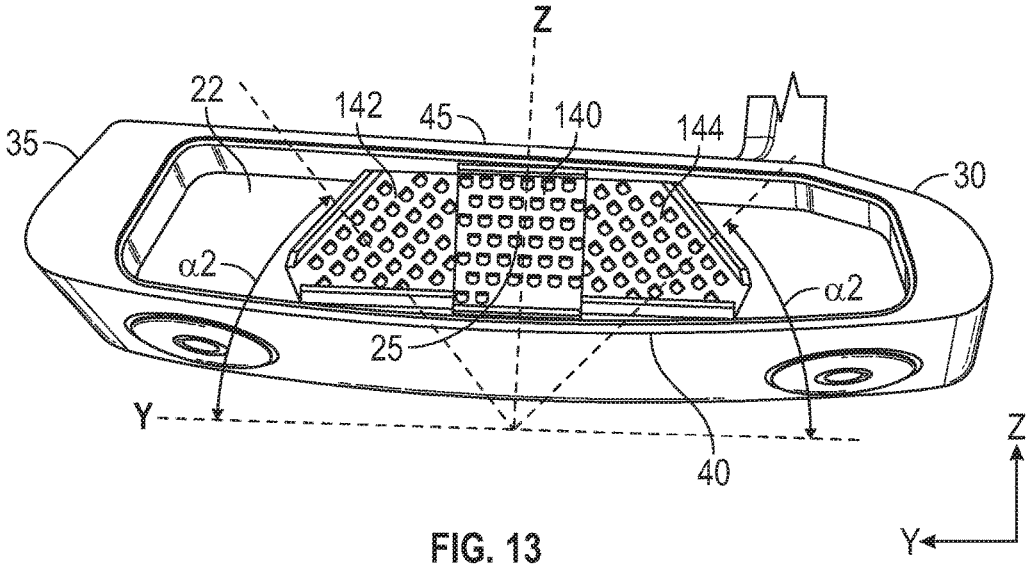
FIG. 13 is a front perspective view of the putter head shown in FIG. 1 with a fifth embodiment of the face insert of the present invention.
Figure 14:
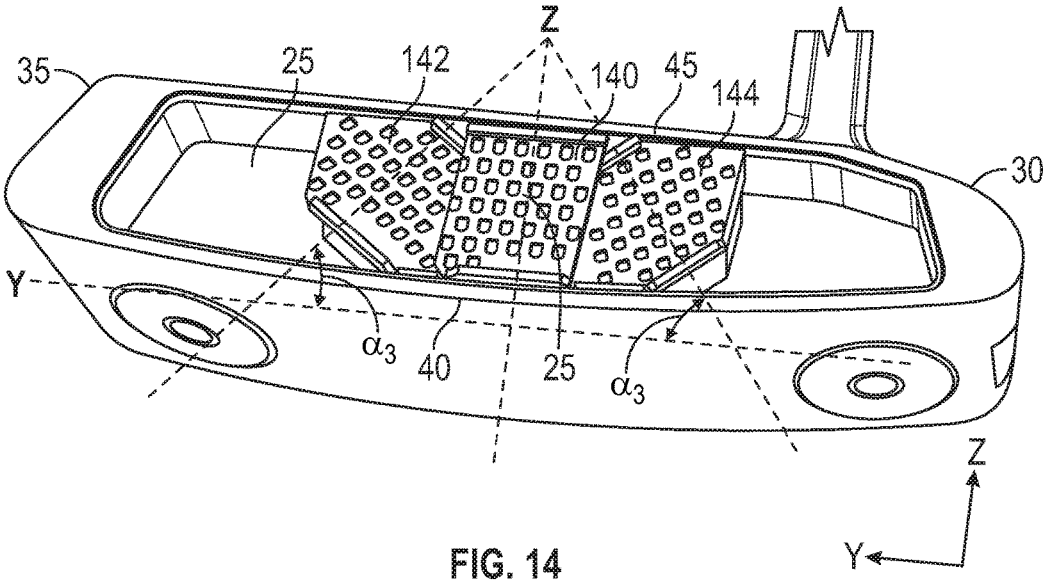
FIG. 14 is a front perspective view of the putter head shown in FIG. 1 with a third embodiment of the face insert of the present invention.

As shown in FIG. 11, the middle section 140 has a first set of hinge features with tab portions 134 extending toward the sole portion 40 along the z-axis, and each of the toe and heel sections 142, 144 have third and second sets, respectively, of hinge features with tab portions 134 extending parallel to the y axis towards the middle section 140. As shown in FIG. 12, the middle section 140 has a first set of hinge features with tab portions 134 extending along the z-axis toward the sole portion 40, the toe section 142 has a third set of hinge features with tab portions 134 extending parallel with the y-axis and toward the toe side 35 of the putter head, and the heel section 144 has a second set of hinge features with tab portions 134 extending parallel to the y-axis and toward the heel side 30 of the putter head. As shown in FIG. 13, the middle section 140 has a first set of hinge features with tab portions 134 extending toward a sole portion 40 along the z-axis, and the toe and heel sections 142, 144 have third and second sets, respectively, of hinge features with tab portions 134 extending toward the middle section 140 at an angle $\alpha 2$ of 10-75°, and more preferably 45°, with the y-axis. As shown in FIG. 14, the middle section 140 has a first set of hinge features with tab portions 134 extending toward the sole portion along the z-axis, and the toe and heel sections 142, 144 have third and second sets, respectively, of hinge features with tab portions 134 extending away from the middle section 140 at an angle $\alpha 3$ of 10-75°, and more preferably 45°, with the y-axis. The angle between the tab portions 134 and the y-axis can change as the distance from a face center 25 increases. In still other, alternative embodiments, the vertical and/or horizontal spacing between the hinge features 130 may vary across the face insert 100, such that more hinge features 130 are located in regions on the face insert 100 where greater resilience is required for improved ball speed.

The striking plate 120 preferably is composed of a metal alloy material such as stainless steel, titanium alloy, or aluminum alloy, though it may be composed of a rigid polymer material in alternative embodiments. When the striking plate 120 is composed of a metal alloy, the hinge features 130 and through-holes 124 may be stamped, chemical etched, machined, and/or otherwise added to the striking plate 120 by any means known to a person skilled in the art. The backing portion 110 preferably is composed of a polymer such as urethane, and preferably is co-molded onto the striking plate 120 so that the polymer material can flow over portions of the striking plate 120, specifically the base portion 122, and into the through-holes 124 underneath the tab portions 134. In alternative embodiments, however, the backing portion 110 may be permanently attached to the striking plate 120 with an adhesive.

Though each of the face insert 100 embodiments disclosed herein are shown in connection with a putter head 10, these embodiments may be used with any other golf club head, including drivers, fairway woods, irons, wedges, and hybrids.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A putter comprising:

a body comprising a top portion, a sole portion, a toe side, a heel side, a rear side, and a face side with a recess; and a face insert comprising a striking plate having a first average thickness and a backing portion having a second average thickness, wherein the face insert is disposed within the recess so that at least a portion of the striking plate is exposed, wherein a horizontal y-axis extends in a heel side to toe side direction parallel with the face side, a vertical z-axis extends perpendicular to the y-axis from the sole portion to the top portion, and a horizontal x-axis extends perpendicular to both the y- and z-axes from the face side to the rear side, wherein the striking plate comprises a base portion, a first set of hinge features, a second set of hinge features, and third set of hinge features, wherein the first set of hinge features comprises a plurality of first hinge features, each extending towards the sole portion parallel with the z-axis, wherein the second set of hinge features comprises a plurality of second hinge features, each extending towards the heel side parallel with the y-axis, wherein the third set of hinge features comprises a plurality of third hinge features, each extending towards the toe side parallel with the y-axis, wherein each of the hinge features of the first, second, and third pluralities of hinge features comprises a stem portion that extends from the base portion at an angle of no less than 45 degrees and no more than 90 degrees with respect to the base portion, and a tab portion that is spaced from the base portion by the stem portion and extends from the stem portion approximately parallel with the base portion without making contact with the base portion, and wherein each tab portion is at least partially disposed over a through-hole extending through the striking plate.

2. The putter of claim 1, wherein the first set of hinge features is disposed between the second and third sets of hinge features.

3. The putter of claim 2, wherein the second set of hinge features is disposed proximate the heel side, and wherein the third set of hinge features is disposed proximate the toe side.

4. The putter of claim 1, wherein the backing portion is composed of a polymeric material, and wherein the striking plate is composed of a metal material.

5. The putter of claim 4, wherein the backing portion is co-molded with the striking plate.

6. The putter of claim 1, wherein the second average thickness is greater than the first average thickness.

7. The putter of claim 6, wherein the first average thickness is less than 25% of an overall average thickness of the face insert.

8. The putter of claim 1, wherein the first set of hinge features is disposed in a middle section of the face insert.

9. A putter comprising:

a body comprising a top portion, a sole portion, a toe side, a heel side, a rear side, and a face side with a recess; and a face insert comprising a striking plate having a first average thickness and a backing portion having a second average thickness, wherein the face insert is disposed within the recess so that at least a portion of the striking plate is exposed, wherein a horizontal y-axis extends in a heel side to toe side direction parallel with the face side, a vertical z-axis extends perpendicular to the y-axis from the sole portion to the top portion, and a horizontal x-axis extends perpendicular to both the y- and z-axes from the face side to the rear side, wherein the striking plate comprises a base portion, a first set of hinge features disposed at a middle section of the striking plate, a second set of hinge features disposed at a heel side of the striking plate, and third set of hinge features disposed at a toe side of the striking plate, wherein the first set of hinge features comprises a plurality of first hinge features, each extending towards the sole portion parallel with the z-axis, wherein the second set of hinge features comprises a plurality of second hinge features, each extending towards the middle section at a first angle of no less than 10° and no more than 75° with respect to the y-axis, wherein the third set of hinge features comprises a plurality of third hinge features, each extending towards the middle section at a second angle of no less than 10° and no more than 75° with respect to the y-axis, wherein each of the hinge features of the first, second, and third pluralities of hinge features comprises a stem portion that extends from the base portion at a stem angle of no more than 90 degrees with respect to the base portion, and a tab portion that is spaced from the base portion by the stem portion and extends from the stem portion approximately parallel with the base portion without making contact with the base portion, and wherein each tab portion is at least partially disposed over a through-hole extending through the striking plate.

10. The putter of claim 9, wherein each of the first and second angles is approximately 45°.

11. The putter of claim 9, wherein the stem angle is between 50° and 60°.

12. The putter of claim 9, wherein the second average thickness is greater than the first average thickness.

13. A putter comprising:

a body comprising a top portion, a sole portion, a toe side, a heel side, a rear side, and a face side with a recess; and a face insert comprising a striking plate having a first average thickness and a backing portion having a second average thickness, wherein the face insert is disposed within the recess so that at least a portion of the striking plate is exposed, wherein a horizontal y-axis extends in a heel side to toe side direction parallel with the face side, a vertical z-axis extends perpendicular to the y-axis from the sole portion to the top portion, and a horizontal x-axis extends perpendicular to both the y- and z-axes from the face side to the rear side, wherein the striking plate comprises a base portion, a first set of hinge features disposed at a middle section of the striking plate, a second set of hinge features disposed at a heel side of the striking plate, and third set of hinge features disposed at a toe side of the striking plate, wherein the first set of hinge features comprises a plurality of first hinge features, each extending towards the sole portion parallel with the z-axis, wherein the second set of hinge features comprises a plurality of second hinge features, each extending away from the middle section at a first angle of no less than 10° and no more than 75° with respect to the y-axis, wherein the third set of hinge features comprises a plurality of third hinge features, each extending away from the middle section at a second angle of no less than 10° and no more than 75° with respect to the y-axis, wherein each of the hinge features of the first, second, and third pluralities of hinge features comprises a stem portion that extends from the base portion at a stem angle of no more than 90 degrees with respect to the base portion, and a tab portion that is spaced from the base portion by the stem portion and extends from the stem portion approximately parallel with the base portion without making contact with the base portion, and wherein each tab portion is at least partially disposed over a through-hole extending through the striking plate.

14. The putter of claim 13, wherein each of the first and second angles is approximately 45°.

15. The putter of claim 13, wherein the stem angle is between 50° and 60°.

16. The putter of claim 13, wherein the second average thickness is greater than the first average thickness.

17. The putter of claim 16, wherein the first average thickness is less than 25% of an overall average thickness of the face insert.

18. The putter of claim 17, wherein the polymeric material is urethane, and wherein the backing portion is co-molded with the striking plate.

19. The putter of claim 13, wherein the backing portion is composed of a polymeric material, and wherein the striking plate is composed of a metal material.

20. The putter of claim 13, wherein each of the hinge features of the first, second, and third pluralities of hinge features has a minimum thickness of no less than 0.005 inch, and a maximum thickness of no more than 0.025 inch.

* * * * *